US005586538A

United States Patent [19]

Barnes

[11] Patent Number: 5,586,538

[45] Date of Patent: Dec. 24, 1996

[54] METHOD OF CORRECTING ENGINE MAPS BASED ON ENGINE TEMPERATURE

[75] Inventor: Travis E. Barnes, Peoria, Ill.

[73] Assignee: Caterpillar Inc., Peoria, Ill.

[21] Appl. No.: 555,468

[22] Filed: Nov. 13, 1995

[51] Int. Cl.[6] ..... F02M 37/04; F02M 7/00

[52] U.S. Cl. ..... 123/446; 123/381

[58] Field of Search ..... 123/446, 381, 123/179.17, 486, 496

[56] References Cited

U.S. PATENT DOCUMENTS

| | | | |
|---|---|---|---|
| 5,121,730 | 6/1992 | Ausman et al. | 123/381 |
| 5,181,494 | 1/1993 | Ausman et al. | 123/179.17 |
| 5,357,912 | 10/1994 | Barnes et al. | 123/381 |
| 5,423,302 | 6/1995 | Glassey | 123/381 |
| 5,445,129 | 8/1995 | Barnes | 123/381 |

*Primary Examiner*—Thomas N. Moulis
*Attorney, Agent, or Firm*—David M. Masterson

[57] ABSTRACT

In one aspect of the present invention, a method for correcting an engine map for use in an electronic control system that regulates the quantity of fuel that a hydraulically-actuated injector dispenses into an engine. The engine map stores a plurality of engine operating curves. The method modifies at least one of the engine operating curves in response to the engine temperature, which is indicative of the temperature of the actuating fluid used to hydraulically actuate the injector. Consequently, the engine map curves are corrected to compensate for changing engine temperatures to insure that the hydraulically-actuated fuel injectors dispense a desired quantity of fuel.

12 Claims, 4 Drawing Sheets

METHOD OF CORRECTING ENGINE MAPS BASED ON ENGINE TEMPERATURE

TECHNICAL FIELD

This invention relates generally to a method for correcting engine maps based on engine temperature; and more particularly, to a method that corrects engine maps in relation to hydraulically actuated fuel injectors.

BACKGROUND ART

Known hydraulically-actuated fuel injector systems and/or components are shown, for example, in U.S. Pat. No. 5,191,867 issued to Glassey et al. on Mar. 9, 1993. Such systems utilize an electronic control module that regulates the quantity of fuel that the fuel injector dispenses. The electronic control module includes software in the form of multi-dimensional lookup tables that are used to define optimum fuel system operational parameters. However such lookup tables, referred to as maps, are typically developed in response to a predetermined engine temperature. Consequently, when the engine temperature deviates from the predetermined engine temperature, the actuating fluid viscosity changes which causes the fuel injectors to dispense a greater or lessor amount of fuel than that desired.

The present invention is directed to overcoming one or more of the problems as set forth above.

DISCLOSURE OF THE INVENTION

In one aspect of the present invention, a method for correcting an engine map for use in an electronic control system that regulates the quantity of fuel that a hydraulically-actuated injector dispenses into an engine. The engine map stores a plurality of engine operating curves. The method modifies at least one of the engine operating curves in response to the engine temperature, which is indicative of the temperature of the actuating fluid used to hydraulically actuate the injector. Consequently, the engine map curves are corrected to compensate for changing engine temperatures to insure that the hydraulically-actuated fuel injectors dispense a desired quantity of fuel.

BRIEF DESCRIPTION OF THE DRAWINGS

For a better understanding of the present invention, reference may be made to the accompanying drawings in which.

BEST MODE FOR CARRYING OUT THE INVENTION

The present invention relates to method for correcting engine maps in response to engine temperature. The engine maps are used by an electronic control system to regulate the operation of a hydraulically-actuated electronically controlled unit injector fuel system. The engine map parameters are corrected to compensate for changing engine temperatures to insure that the hydraulically-actuated fuel injectors dispense a desired quantity of fuel. One example of a hydraulically actuated electronically controlled unit injector fuel system is shown in U.S. Pat. No. 5,191,867, issued to Glassey on Mar. 9, 1993, the disclosure of which is incorporated herein by reference. The term "map", as used herein, refers to a multi-dimensional software lookup table, as is well known in the art. Such engine maps may include torque maps, smoke maps, or any other type of map that is used in the control of engine operation.

Figure 1:
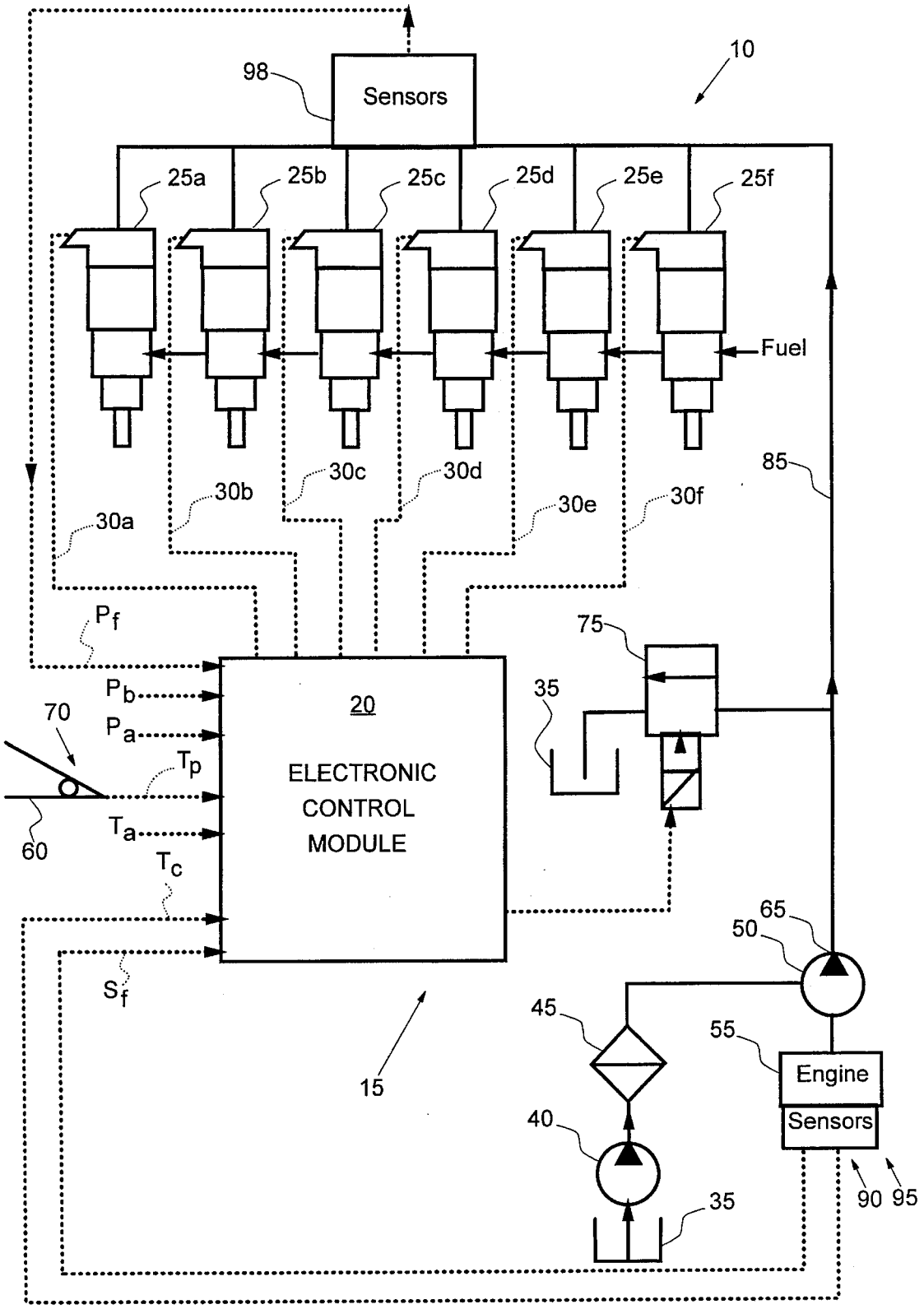
FIG. 1 shows a diagrammatic view of a hydraulically-actuated electronically-controlled injector fuel system for an engine having a plurality of injectors.

Throughout the specification and figures, like reference numerals refer to like components or parts. Referring first to FIG. 1, the electronic control system 10 for a hydraulically actuated electronically controlled unit injector fuel system is shown, hereinafter referred to as the HEUI fuel system. The control system includes an Electronic Control Module 20, hereinafter referred to as the ECM. In the preferred embodiment the ECM is a Motorola microcontroller, model no. 68HC 11. However, other suitable microcontrollers may be used in connection with the present invention as would be known to one skilled in the art.

The electronic control system 10 includes hydraulically actuated electronically controlled unit injectors 25*a–f* which are individually connected to outputs of the ECM by electrical connectors 30*a–f* respectively. In FIG. 1, six such unit injectors 25*a–f* are shown illustrating the use of the electronic control system 10 with a six cylinder engine 55. However, the present invention is not limited to use in connection with a six cylinder engine. To the contrary, it may be easily modified for use with an engine having any number of cylinders and unit injectors 25. Each of the unit injectors 25*a–f* is associated with an engine cylinder as is known in the art. Thus, to modify the preferred embodiment for operation with an eight cylinder engine would require two additional unit injectors 25 for a total of eight such injectors 25.

Actuating fluid is required to provide sufficient pressure to cause the unit injectors 25 to open and inject fuel into an engine cylinder. In a preferred embodiment, the actuating fluid comprises engine oil where the oil supply is found in a sump 35. Low pressure oil is pumped from the oil pan by a low pressure pump 40 through a filter 45, which filters impurities from the engine oil. The filter 45 is connected to a high pressure fixed displacement supply pump 50 which is mechanically linked to, and driven by, the engine 55. High pressure actuating fluid (in the preferred embodiment, engine oil) enters an Injector Actuation Pressure Control Valve 75, hereinafter referred to as the IAPCV. To control the actuating fluid pressure, the IAPCV regulates the flow of actuating fluid to the sump 35, where the remainder of the actuating fluid flows to the injectors 25 via rail 85. Consequently, the rail pressure or actuating fluid pressure is controlled by regulating the flow of fluid to the sump 35.

Preferably, the IAPCV is a proportional solenoid actuated valve. Other devices, which are well known in the art, may be readily and easily substituted for the fixed displacement pump 50 and the IAPCV. For example, one such device includes a variable displacement pump. In a preferred embodiment, the IAPCV and the fixed displacement pump 50 permits the ECM to maintain a desired pressure of actuating fluid.

The ECM contains software decision logic and information defining optimum fuel system operational parameters and controls key components. Multiple sensor signals, indicative of various engine parameters are delivered to the ECM to identify the engine's current operating condition. The ECM uses these input signals to control the operation of the fuel system in terms of fuel injection quantity, injection timing, and actuating fluid pressure. For example, the ECM produces the waveforms required to drive the IAPCV and a solenoid of each injector.

Sensor inputs may include: an engine speed sensor 90 that reads the signature of a timing wheel of the engine camshaft and delivers an actual engine speed signal $S_f$ to the ECM to indicate the engine's rotational position and speed; an actuating fluid pressure sensor 90 that senses the pressure of the rail 85 and delivers an actual actuating fluid pressure signal $P_f$ to the ECM to indicate the actuating fluid pressure; a throttle position sensor 70 that senses the position of a throttle 60 and delivers a throttle position signal $T_p$ to the ECM to indicate the throttle position; and a coolant temperature sensor 95 that senses the temperature of the engine coolant and delivers an actual engine coolant temperature signal $T_c$ to the ECM to indicate the actuating fluid temperature.

Figure 2:
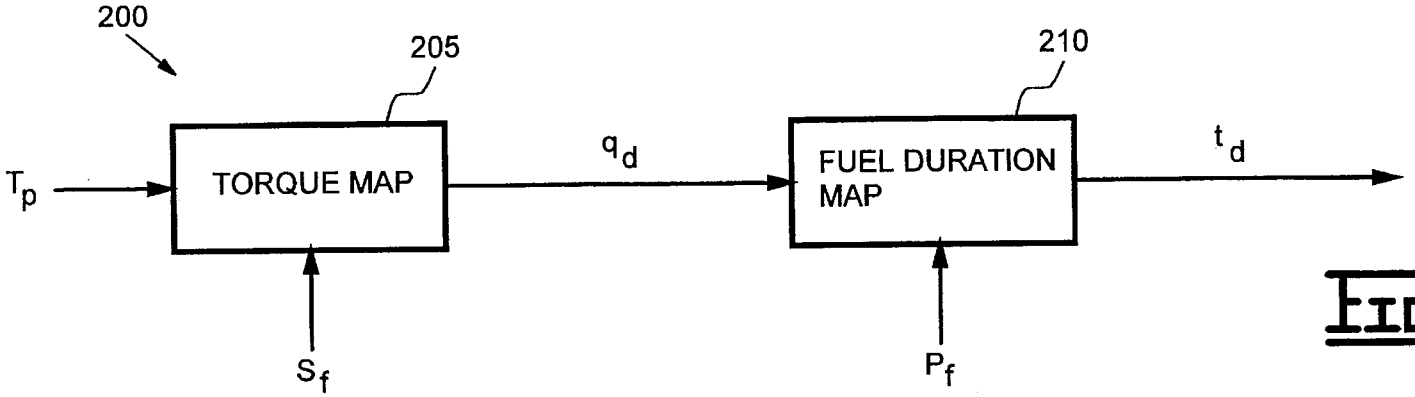
FIG. 2 shows a block diagram of one embodiment of a control strategy that regulates the quantity of fuel that the fuel injectors dispense.

One embodiment 200 of the software decision logic for determining the magnitude of the fuel injection quantity of each injector 25 is shown in FIG. 2. A throttle position signal $T_p$ and an actual engine speed signal $S_f$ are input into a torque limiting map 205. One example of a torque map 205 is shown with reference to FIG. 3. As shown, the map contains a plurality of throttle position curves, each curve having a plurality of values that correspond to an actual engine speed and desired fuel quantity. Consequently, based on the magnitude of the throttle position signal and the actual engine speed signal, a desired fuel quantity is selected and a respective desired fuel quantity signal $q_d$ is produced. The desired fuel quantity signal $q_d$ and an actual actuating fluid pressure signal $P_f$ are input into a fuel duration map 210 that converts the desired fuel quantity signal $q_d$ into an equivalent time duration signal $t_d$ used to electronically control the solenoid of the injector 25. The fuel duration map 210 reflects the fuel delivery characteristics of the injector 25 to changes in actuating fluid pressure. The time duration signal $t_d$ indicates how long the ECM is to energize the solenoid of a respective injector 25 in order to inject the correct quantity of fuel from the injector 25.

Figure 3:
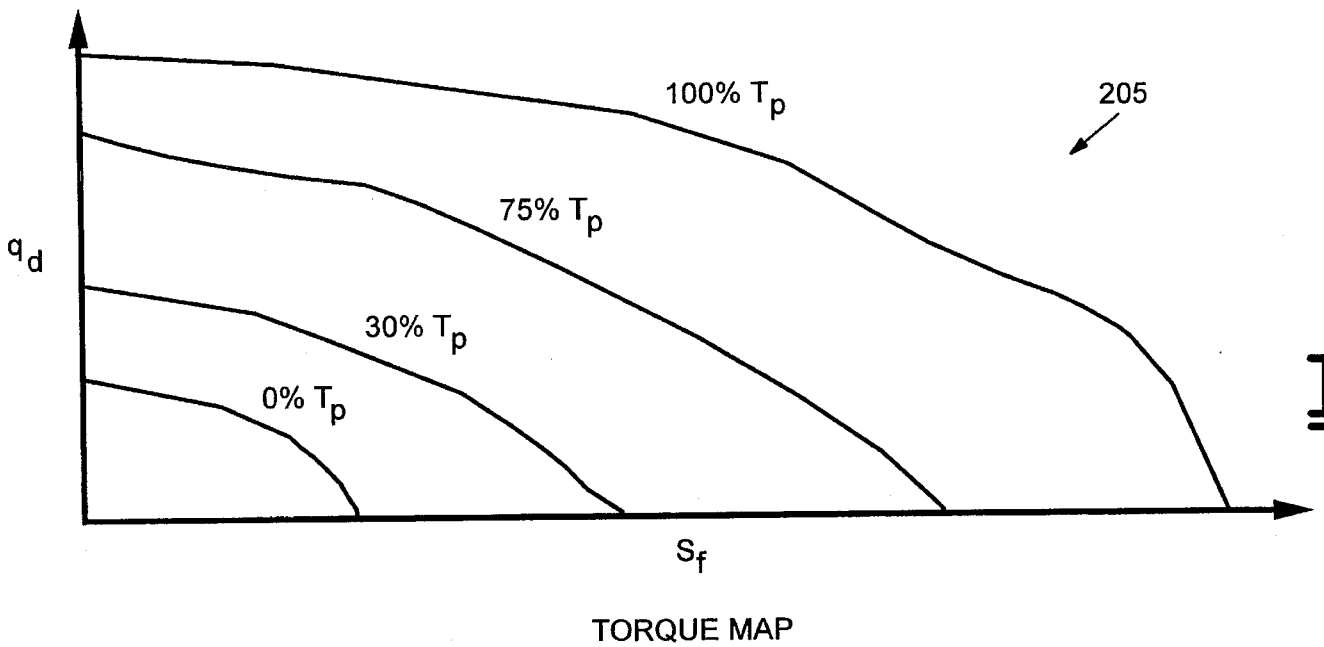
FIG. 3 shows a view of a torque limit map used to determine the desired quantity fuel that the fuel injectors are to dispense.

Torque maps, like that illustrated in FIG. 3, are typically developed with respect to a predetermined engine temperature. However, as the engine temperature changes, the viscosity of the actuating fluid changes, which in turn, effects the quantity of fuel that the hydraulically-actuated fuel injectors dispense. Advantageously, the present invention modifies the throttle position curves that are contained in the torque map in response to the actuating fluid temperature to provide for consistent fuel delivery.

Figure 4:
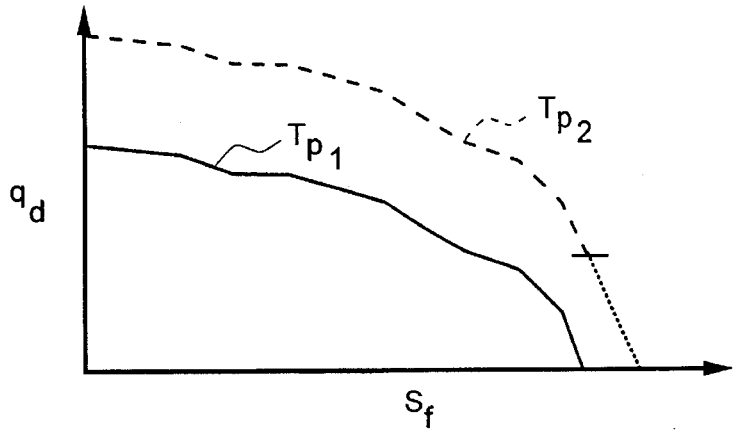
FIG. 4 shows a partial view of a torque limit map that has been modified in response to an offset function.
Figure 5:
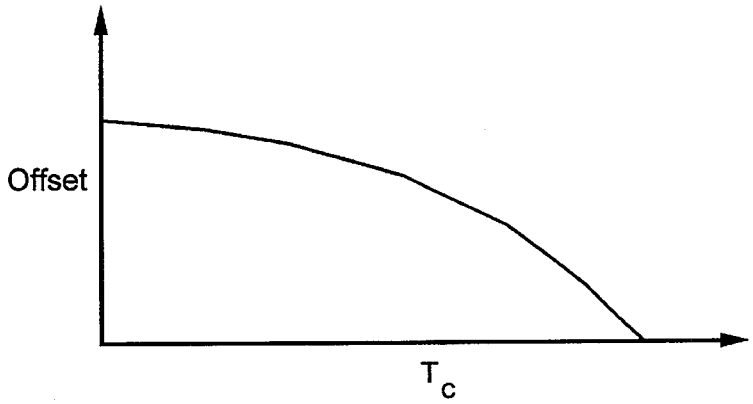
FIG. 5 shows the magnitude of the offset function in relation to engine temperature.

Reference is now made to FIG. 4, which shows one method of modifying the throttle curves. Here, a modified throttle curve $T_{p2}$, shown by the "dashed" line, is offset from an original throttle curve $T_{p1}$. The modified curve is offset from the original curve by an amount that is a function of engine temperature. For example, the offset value may be determined from a map similar to that shown in FIG. 5. As shown, the offset value is a function of coolant temperature, which is indicative of the actuating fluid temperature.

Note that the illustrated throttle curves of FIG. 3 intersect the engine speed axis at a predetermined engine speed to represent that fuel delivery is halted at that speed. Consequently, the modified throttle curve $T_{p2}$ must be extended to intersect the engine speed axis in order to provide for the desired engine operating performance. The extension is shown by the "dotted" line. Thus, the extension provides for the fuel delivery to ramp down to zero at a predetermined rate.

Figure 6:
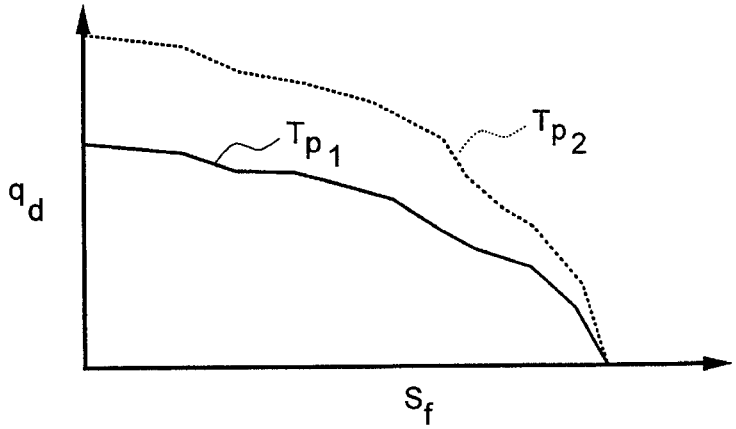
FIG. 6 shows a partial view of a torque limit map that has been modified in response to a scaling function.
Figure 7:
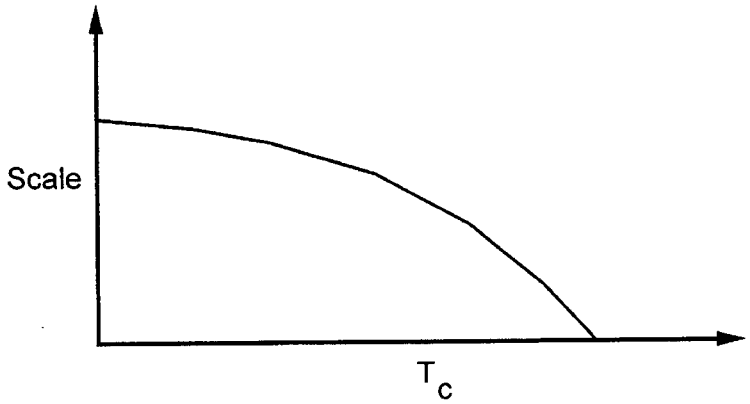
FIG. 7 shows the magnitude of the scaling function in relation to engine temperature.

Another method of modifying the throttle curves is shown in FIG. 6 where the modified curve $T_{p2}$ is scaled from the original curve $T_{p1}$. Here, not only is the modified curve offset from the original curve, but the slope of the modified curve is changed as well. For example, the scaling value may be determined from a map similar to that shown in FIG. 5. As shown, the scaling value is a function of coolant temperature. The scaling method provides for engine to have full torque capability at low engine speeds, while limiting power at high engine speeds under cold operating conditions.

Figure 8:
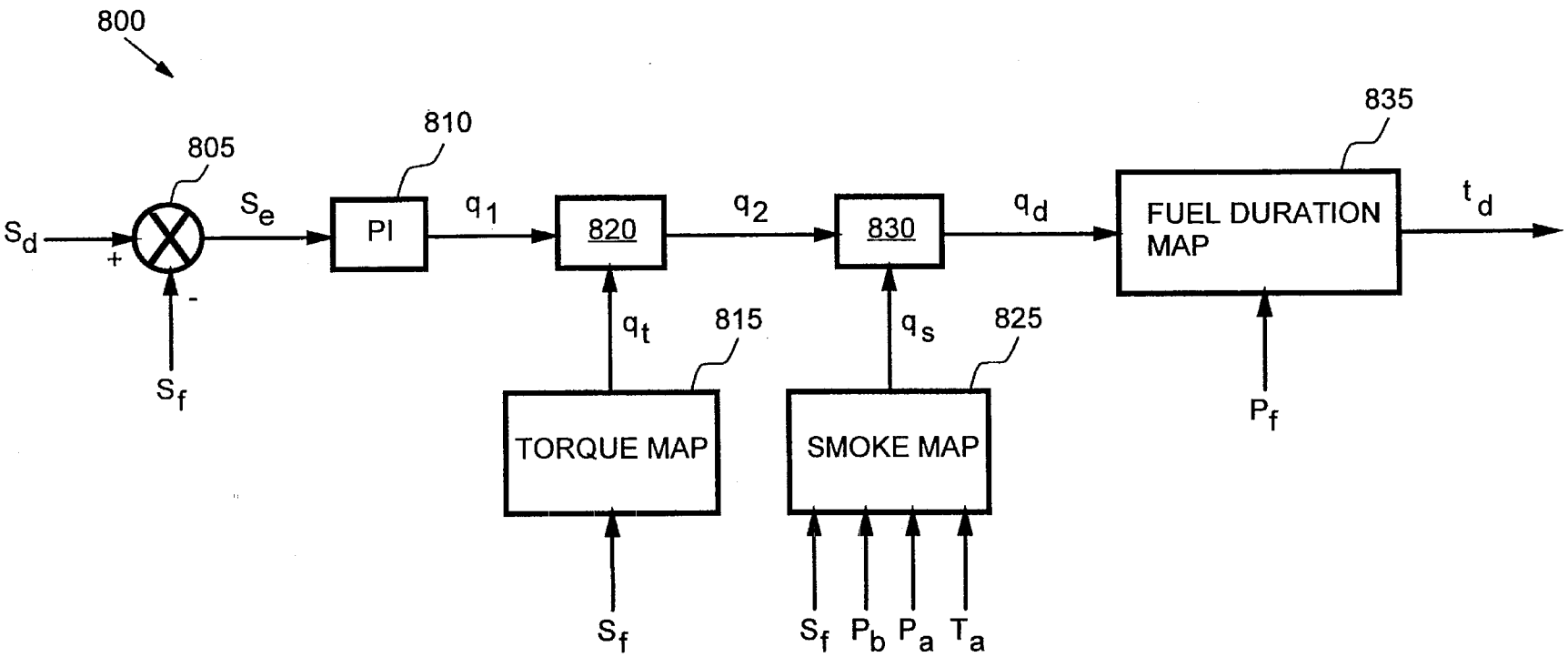
FIG. 8 shows a block diagram of another embodiment of a control strategy that regulates the quantity of fuel that the fuel injectors dispense.

The present invention is additionally applicable to other fuel system control strategies, such as control strategy that uses a closed loop governor. Such a system 800 is shown with respect to FIG. 8. Here, a desired engine speed signal $S_d$ is produced from one of several possible sources such as operator throttle setting, cruise control logic, power take-off speed setting, or environmentally determined speed setting due to, for example, engine coolant temperature. A speed comparing block 805 compares the desired engine speed signal $S_d$ with an actual engine speed signal $S_f$ to produce an engine speed error signal $S_e$. The engine speed error signal $S_e$ becomes an input to a Proportional Integral (PI) control block 810 whose output is a first fuel quantity signal $q_1$. The PI control calculates the quantity of fuel that would be needed to accelerate or decelerate the engine speed to result in a zero engine speed error signal $S_e$. Note that, although a PI control is discussed, it will be apparent to those skilled in the art that other closed loop governors may be utilized.

The first fuel quantity signal $q_1$ is preferably compared to the maximum allowable fuel quantity signal $q_t$ at comparing block 820. The maximum allowable fuel quantity signal $q_t$ is produced by a torque map 815. More particularly, the torque map 815 receives the actual engine speed signal $S_f$ and produces the maximum allowable fuel quantity signal $q_t$ that preferably determines the horsepower and torque characteristics of the engine 55. The comparing block 820 compares the maximum allowable fuel quantity signal $q_t$ to the first fuel quantity signal $q_1$, and the lesser of the two values becomes a second fuel quantity signal $q_2$.

The second fuel quantity signal $q_2$, may then be compared to another maximum allowable fuel quantity signal $q_s$ at comparing block 830. The maximum allowable fuel quantity signal $q_s$ is produced by block 825, which includes an emissions limiter or smoke map that is used to limit the amount of smoke produced by the engine 55. The smoke map 825 is a function of several possible inputs including: an air inlet pressure signal $P_b$ indicative of, for example, air manifold pressure or boost pressure, an ambient pressure signal $P_a$, and an ambient temperature signal $T_a$. The maximum allowable fuel quantity signal $q_s$, limits the quantity of fuel based on the quantity of air available to prevent excess smoke. Note that, although two limiting blocks 815,825 are shown, it may be apparent to those skilled in the art that other such blocks may be employed. The comparing block 830 compares the maximum allowable fuel quantity signal $q_s$ to the second fuel quantity signal $q_2$, and the lesser of the two values becomes the desired fuel quantity signal $q_d$. The desired fuel quantity signal $q_d$ and the actual actuating fluid pressure signal $P_f$ are input into a fuel duration map 835 that converts the desired fuel quantity signal $q_d$ into an equivalent time duration signal $t_d$ used to electronically control the solenoid of the injector 25.

Because the torque map 815 and smoke map 825 each include a plurality of engine operating curves, the present invention may be used to correct the characteristics of the torque map 815 and the smoke map 825 in a manner similar to that described above.

Other aspects, objects and advantages of the present invention can be obtained from a study of the drawings, the disclosure and the appended claims.

I claim:

1. A method for electronically controlling the quantity of fuel that a hydraulically-actuated injector dispenses into an engine, the method comprising the steps of:

storing a plurality of engine operating curves;

sensing the temperature of the engine and producing an engine temperature signal $T_c$ indicative of the temperature of the actuating fluid used to hydraulically actuate the injector; and receiving the engine temperature signal $T_c$ and modifying at least one of the engine operating curves in response to the sensed engine temperature.

2. A method, as set forth in claim 1, including the step of offsetting one of the engine operating curves by an offset value that is a function of temperature.

3. A method, as set forth in claim 1, including the step of scaling one of the engine operating curves by a scaling value that is a function of temperature.

4. A method for electronically controlling the quantity of fuel that a hydraulically-actuated injector dispenses into an engine having a throttle, the method comprising the steps of:

storing a plurality of engine operating curves;

sensing the speed of the engine and producing an actual engine speed signal $S_f$ indicative of the engine speed;

sensing the temperature of the engine and producing an engine temperature signal $T_c$ indicative of the temperature of the actuating fluid used to hydraulically actuate the injector; and receiving the engine temperature signal $T_c$ and modifying at least one of the engine operating curves in response to the sensed engine temperature; and receiving the actual engine speed signal $S_f$, determining a desired fuel quantity from the modified engine operating curve in response to the sensed engine temperature, and producing a desired fuel quantity signal $q_d$.

5. A method, as set forth in claim 4, wherein the stored engine operating curves represent a plurality of throttle positions, each curve having a plurality of values that correspond to an actual engine speed and a desired fuel quantity.

6. A method, as set forth in claim 5, including the steps of:

sensing the throttle position and producing a throttle position signal $T_p$ indicative of the throttle position; and receiving the throttle position signal $T_p$ and the actual engine speed signal $S_f$, selecting a desired fuel quantity, and producing the desired fuel quantity signal $q_d$.

7. A method, as set forth in claim 6, including the steps of:

sensing an actual actuating fluid pressure and producing an actual actuating fluid pressure signal $P_f$ indicative of the magnitude of the sensed actuating fluid pressure; and receiving the desired fuel quantity signal $q_d$ and the actual actuating fluid pressure signal $P_f$, and converting the desired fuel quantity signal $q_d$ into an equivalent time duration signal $t_d$ to electronically control the fuel quantity dispensed by the injector.

8. A method for electronically controlling the quantity of fuel that a hydraulically-actuated injector dispenses into an engine, the method comprising the steps of:

storing a plurality of engine operating curves;

sensing an actual engine speed and producing an actual engine speed signal $S_f$ indicative of the sensed engine speed;

sensing the temperature of the engine and producing an engine temperature signal $T_c$ indicative of the temperature of the actuating fluid used to hydraulically actuate the injector;

receiving the engine temperature signal $T_c$ and modifying at least one of the engine operating curves in response to the sensed engine temperature; and receiving the actual engine speed signal $S_f$, determining a maximum allowable fuel quantity from the modified engine operating curve in response to the sensed engine temperature, and producing a maximum allowable fuel quantity signal $q_r$,$q_s$.

9. A method, as set forth in claim 8, including the steps of producing a desired engine speed signal $S_d$, comparing the desired engine speed signal $S_d$ with the actual engine speed signal $S_f$, and producing an engine speed error signal $S_e$.

10. A method, as set forth in claim 9, including the steps of:

receiving the engine speed error signal $S_e$ and producing a first fuel quantity signal $q_1$; and comparing the first fuel quantity signal $q_1$ to the maximum allowable fuel quantity signal $q_r$, and producing a second fuel quantity signal $q_2$ in response to the lessor of the maximum allowable fuel quantity and the first fuel quantity signals $q_r$,$q_1$.

11. A method, as set forth in claim 10, including the steps of comparing the second fuel quantity signal $q_2$ to the maximum allowable fuel quantity signal $q_s$, and producing a desired fuel quantity signal $q_d$ in response to the lessor of the maximum allowable fuel quantity and the second fuel quantity signals $q_s$,$q_1$.

12. A method, as set forth in claim 11, including the steps of:

sensing an actual actuating fluid pressure and producing an actual actuating fluid pressure signal $P_f$ indicative of the magnitude of the sensed actuating fluid pressure; and receiving the desired fuel quantity signal $q_d$ and the actual actuating fluid pressure signal $P_f$, and converting the desired fuel quantity signal $q_d$ into an equivalent time duration signal $t_d$ to electronically control the fuel quantity dispensed by the injector.

* * * * *